US010436445B2

(12) United States Patent
Willis et al.

(10) Patent No.: US 10,436,445 B2
(45) Date of Patent: Oct. 8, 2019

(54) ASSEMBLY FOR CONTROLLING CLEARANCE BETWEEN A LINER AND STATIONARY NOZZLE WITHIN A GAS TURBINE

(71) Applicant: General Electric Company, Schenectady, NY (US)

(72) Inventors: Christopher Paul Willis, Liberty, SC (US); Richard Martin DiCintio, Simpsonville, SC (US); Patrick Benedict Melton, Horse Shoe, NC (US); Lucas John Stoia, Taylors, SC (US)

(73) Assignee: General Electric Company, Schenectady, NY (US)

( * ) Notice: Subject to any disclaimer, the term of this patent is extended or adjusted under 35 U.S.C. 154(b) by 743 days.

(21) Appl. No.: 13/845,565

(22) Filed: Mar. 18, 2013

(65) Prior Publication Data

US 2014/0260280 A1 Sep. 18, 2014

(51) Int. Cl.
*F01D 9/02* (2006.01)
*F23R 3/60* (2006.01)
(Continued)

(52) U.S. Cl.
CPC ..... *F23R 3/002* (2013.01); *F01D 9/023* (2013.01); *F01D 11/18* (2013.01); *F01D 25/24* (2013.01);
(Continued)

(58) Field of Classification Search
CPC ..... F01D 9/023; F01D 11/00; F01D 11/003; F01D 11/005; F01D 9/00; F01D 9/02; F23R 3/60; F23R 3/002
See application file for complete search history.

(56) References Cited

U.S. PATENT DOCUMENTS 3,609,968 A * 10/1971 Mierley, Sr. ..... F01D 11/005 415/111
3,741,678 A * 6/1973 Arlington ..... F01D 9/023 415/117
(Continued)

FOREIGN PATENT DOCUMENTS

EP 0526058 A1 2/1993
EP 0578461 A1 1/1994
EP 1884297 A1 2/2008

OTHER PUBLICATIONS

Co-Pending U.S. Appl. No. 13/845,439, dated Mar. 18, 2013.
(Continued)

*Primary Examiner* — William H Rodriguez
*Assistant Examiner* — Thomas P Burke
(74) *Attorney, Agent, or Firm* — Dority & Manning, P.A.

(57) ABSTRACT

An assembly for controlling a gap between a liner and a stationary nozzle within a gas turbine includes an annular liner having an aft frame that is disposed at an aft end of the liner, and a mounting bracket that is coupled to the aft frame. The assembly further includes a turbine having an outer turbine shell and an inner turbine shell that at least partially defines an inlet to the turbine. A stationary nozzle is disposed between the aft frame and the inlet. The stationary nozzle includes a top platform portion having a leading edge that extends towards the aft frame and a bottom platform portion. A gap is defined between the aft end of the aft frame and the leading edge of the top platform portion. The mounting bracket is coupled to the outer turbine shell, and stationary nozzle is coupled to the inner turbine shell.

10 Claims, 6 Drawing Sheets

(51) Int. Cl.
*F23R 3/00* (2006.01)
*F01D 11/18* (2006.01)
*F01D 25/24* (2006.01)

(52) U.S. Cl.
CPC ..... *F23R 3/005* (2013.01); *F23R 3/60* (2013.01); *F05D 2230/642* (2013.01); *F05D 2300/50212* (2013.01); *F23R 2900/00012* (2013.01)

(56) References Cited

U.S. PATENT DOCUMENTS 3,750,398 A * 8/1973 Adelizzi ..... F01D 9/023 415/117
3,872,664 A 3/1975 Lohmann
4,265,615 A 5/1981 Lohmann
4,420,929 A 12/1983 Jorgensen
5,069,029 A 12/1991 Kuroda
5,201,847 A * 4/1993 Whidden ..... F01D 9/023 415/177
5,380,154 A 1/1995 Norton
5,450,725 A 9/1995 Takahara
5,475,979 A 12/1995 Oag
5,802,854 A 9/1998 Maeda
5,848,874 A * 12/1998 Heumann ..... F01D 9/042 411/24
6,047,550 A 4/2000 Beebe
6,148,604 A 11/2000 Salt
6,212,870 B1 4/2001 Thompson et al.
6,374,594 B1 4/2002 Kraft et al.
6,442,946 B1 * 9/2002 Kraft ..... F01D 9/023 60/796
6,450,762 B1 9/2002 Munshi
6,543,993 B2 4/2003 Burdgick et al.
6,654,710 B1 11/2003 Keller
6,875,009 B2 4/2005 Kayahara et al.
6,896,509 B2 5/2005 Carroni et al.
6,957,949 B2 10/2005 Hyde et al.
7,082,766 B1 8/2006 Widener et al.
7,743,612 B2 6/2010 Morenko
8,096,131 B2 1/2012 Ziaei et al.
8,158,428 B1 * 4/2012 Krishna ..... G01N 25/72 250/339.14
8,171,738 B2 5/2012 Fish et al.
2002/0184893 A1 12/2002 Farmer
2003/0039542 A1 2/2003 Cromer
2004/0036230 A1 * 2/2004 Matsuda ..... F01D 9/023 277/632
2004/0047725 A1 * 3/2004 Tomita ..... F01D 11/005 415/116
2005/0044855 A1 3/2005 Crawley
2005/0095123 A1 * 5/2005 Taillant ..... F16J 15/0887 415/174.2
2005/0241317 A1 11/2005 Martling
2005/0268617 A1 12/2005 Amond
2008/0053107 A1 * 3/2008 Weaver ..... F01D 9/023 60/800
2008/0282667 A1 11/2008 Intile
2009/0071157 A1 3/2009 Cai
2009/0110549 A1 * 4/2009 Snook ..... F01D 11/005 415/191
2009/0199561 A1 8/2009 Hessler
2010/0054928 A1 3/2010 Schiavo
2010/0071377 A1 3/2010 Fox
2010/0139283 A1 6/2010 Phillips et al.
2010/0170216 A1 7/2010 Venkataraman
2010/0174466 A1 7/2010 Davis, Jr. et al.
2010/0263386 A1 10/2010 Edwards
2011/0000218 A1 * 1/2011 Arase ..... F01D 25/246 60/772
2011/0067402 A1 3/2011 Wiebe
2011/0146284 A1 6/2011 Morimoto
2011/0247314 A1 10/2011 Chila
2011/0304104 A1 12/2011 McMahan
2012/0073304 A1 * 3/2012 Butkiewicz ..... F01D 9/023 60/772
2012/0186260 A1 7/2012 DiCintio et al.
2012/0210729 A1 8/2012 Cihlar et al.
2012/0304648 A1 12/2012 Byrne
2014/0033728 A1 2/2014 Marmilic
2014/0260272 A1 9/2014 DiCintio

OTHER PUBLICATIONS

Co-Pending U.S. Appl. No. 13/845,365, dated Mar. 18, 2013.
Co-Pending U.S. Appl. No. 13/845,485, dated Mar. 18, 2013.
Co-Pending U.S. Appl. No. 13/845,617, dated Mar. 18, 2013.
Co-Pending U.S. Appl. No. 13/845,661, dated Mar. 18, 2013.
Co-Pending U.S. Appl. No. 13/845,699, dated Mar. 18, 2013.
Co-Pending U.S. Appl. No. 13/845,378, dated Mar. 18, 2013.
Co-Pending U.S. Appl. No. 13/845,384, dated Mar. 18, 2013.

* cited by examiner

ASSEMBLY FOR CONTROLLING CLEARANCE BETWEEN A LINER AND STATIONARY NOZZLE WITHIN A GAS TURBINE

FIELD OF THE INVENTION

The present invention generally involves a gas turbine. More specifically, the invention relates to an assembly for controlling a gap between an aft end of a combustion liner and a first stage of stationary nozzles disposed within the gas turbine, during various thermal transients that correspond to various operation modes of the gas turbine.

BACKGROUND OF THE INVENTION

Turbine systems are widely used in fields such as power generation and aviation. A typical gas turbine includes a compressor section, a combustion section downstream from the compressor section, and a turbine section that is downstream from the combustion section. At least one shaft extends axially at least partially through the gas turbine. A generator/motor may be coupled to the shaft at one end. The combustion section generally includes a casing and a plurality of combustors arranged in an annular array around the casing. The casing at least partially defines a high pressure plenum that surrounds at least a portion of the combustors.

In operation, compressed air is routed from the compressor section to the high pressure plenum that surrounds the combustors. The compressed air is routed to each of the combustors where it is mixed with a fuel and combusted. Combustion gases having a high velocity and pressure are routed from each combustor through one or more liners, through a first stage of stationary nozzles or vanes and into the turbine section where kinetic and/or thermal energy from the hot gases of combustion is transferred to a plurality of rotatable turbine blades which are coupled to the shaft. As a result, the shaft rotates, thereby producing mechanical work. For example, the shaft may drive the generator to produce electricity.

Each combustor includes an end cover that is coupled to the casing. At least one fuel nozzle extends axially downstream from the end cover and at least partially through a cap assembly that extends radially within the combustor. An annular liner such as a combustion liner or a transition duct extends downstream from the cap assembly to at least partially define a combustion chamber within the casing. The liner at least partially defines a hot gas path for routing the combustion gases through the high pressure plenum towards an inlet of the turbine section. An aft frame or support frame circumferentially surrounds a downstream end of the liner, and a bracket is coupled to the aft frame for mounting the liner. The aft frame terminates at a point that is generally adjacent to a first stage nozzle which at least partially defines the inlet to the turbine section.

In some gas turbines, the liner and the first stage nozzle are mounted to a common inner support ring and/or a common outer support ring. In this manner, relative motion between the liner and the first stage nozzle is minimized as the gas turbine transitions through various thermal transients such as during startup and/or turndown operation of the gas turbine. Although this mounting scheme is effective, it is necessary to leave a gap between the aft frame and/or the liner and the first stage nozzle to allow for thermal growth and/or movement of the liner and/or the first stage nozzle as the gas turbine transitions through the various thermal transients.

The size of the gap is generally important for at least two reasons. First, the gap must be sufficient to prevent contact between the aft frame and the first stage nozzle during operation of the gas turbine. Second, the gap must be as small as possible to prevent a portion of the high pressure combustion gases from leaking from the hot gas path through the gap and into the high pressure plenum, thereby impacting the overall performance and/or efficiency of the gas turbine. As a result, seals are required to reduce and/or to seal the gap.

In particular gas turbines, the turbine section includes both an outer turbine shell and an inner turbine shell. In this configuration, the liner is coupled to the inner support ring and the first stage nozzle is coupled and/or in contact with both the inner support ring and the inner turbine shell. Generally, the inner turbine shell is constrained at an aft end of the turbine section, and the inner support ring is mounted to a separate structure. As a result, the inner turbine shell and the inner support ring tend to translate and grow thermally in different directions which results in an increase in relative motion between the liner and the first stage nozzle as compared to when the liner and the first stage nozzle are mounted to common inner and/or outer support rings.

The relative motion between the liner and the first stage nozzle requires a large gap between the aft frame and the first stage nozzle to prevent contact between the two components during operation of the gas turbine. As a result, larger seals must be developed to reduce or prevent leakage of the combustion gases from the hot gas path. However, uncertainties in the motion of the components as well as high temperatures tend to limit the life and/or the effectiveness of the seals. Therefore, an assembly which controls and/or minimizes a gap size or clearance between a liner and a stationary nozzle within a gas turbine having an inner and an outer turbine shell during various thermal transients would be useful.

BRIEF DESCRIPTION OF THE INVENTION

Aspects and advantages of the invention are set forth below in the following description, or may be obvious from the description, or may be learned through practice of the invention.

One embodiment of the present invention is an assembly for controlling a gap between a liner and a stationary nozzle within a gas turbine. The assembly generally includes a liner that extends at least partially though a combustion section of a gas turbine. The liner at least partially defines a hot gas path through the combustor. An aft frame is disposed at an aft end of the liner and a mounting bracket is coupled to the aft frame. A turbine includes an outer turbine shell and an inner turbine shell. The inner turbine shell is disposed within the outer turbine shell. The inner turbine shell at least partially defines an inlet to the turbine. A stationary nozzle is disposed between the aft frame and the inlet. The stationary nozzle includes a top platform portion and a bottom platform portion. The top platform portion includes a leading edge that extends towards the aft frame. A gap is defined between the aft end of the aft frame and the leading edge of the top platform portion. The mounting bracket is coupled to the outer turbine shell and the top platform portion of the stationary nozzle is coupled to the inner turbine shell.

Another embodiment of the present invention is a gas turbine. The gas turbine generally includes a compressor discharge casing that at least partially surrounds a combustion section of the gas turbine. A turbine section having an outer turbine shell is connected to the compressor discharge casing. An inner turbine shell is disposed within the outer turbine shell. The outer turbine shell and the compressor discharge casing at least partially define a high pressure plenum within the gas turbine. An annular liner extends at least partially through the high pressure plenum. The liner includes a forward end and an aft end. The aft end is at least partially surrounded by a radially extending aft frame. The aft frame is coupled to the outer turbine shell. A stage of stationary nozzles is disposed between the aft frame and a stage of rotatable turbine blades of the turbine section. The stage of stationary nozzles is connected to the inner turbine shell.

The present invention may also include a gas turbine. The gas turbine generally includes a compressor discharge casing that at least partially surrounds a combustion section of the gas turbine. A combustor extends through the compressor discharge casing. The combustor includes an annular cap assembly that extends radially and axially within the combustor. An annular liner extends downstream from the cap assembly. The liner has an aft frame that is disposed at an aft end of the liner. The aft frame extends circumferentially around at least a portion of the aft end. A turbine includes an outer turbine shell and an inner turbine shell. The inner turbine shell is at least partially disposed within the outer turbine shell. The inner turbine shell at least partially defines an inlet to the turbine. A stationary nozzle is disposed between the aft frame and the inlet. The stationary nozzle includes a top platform portion. The top platform portion has a leading edge that extends towards the aft frame. A gap is defined between the aft end of the aft frame and the leading edge of the top platform portion. The aft frame is coupled to the outer turbine shell and the top platform portion of the stationary nozzle is coupled to the inner turbine shell.

Those of ordinary skill in the art will better appreciate the features and aspects of such embodiments, and others, upon review of the specification.

BRIEF DESCRIPTION OF THE DRAWINGS

A full and enabling disclosure of the present invention, including the best mode thereof to one skilled in the art, is set forth more particularly in the remainder of the specification, including reference to the accompanying figures, in which.

DETAILED DESCRIPTION OF THE INVENTION

Figure 1:
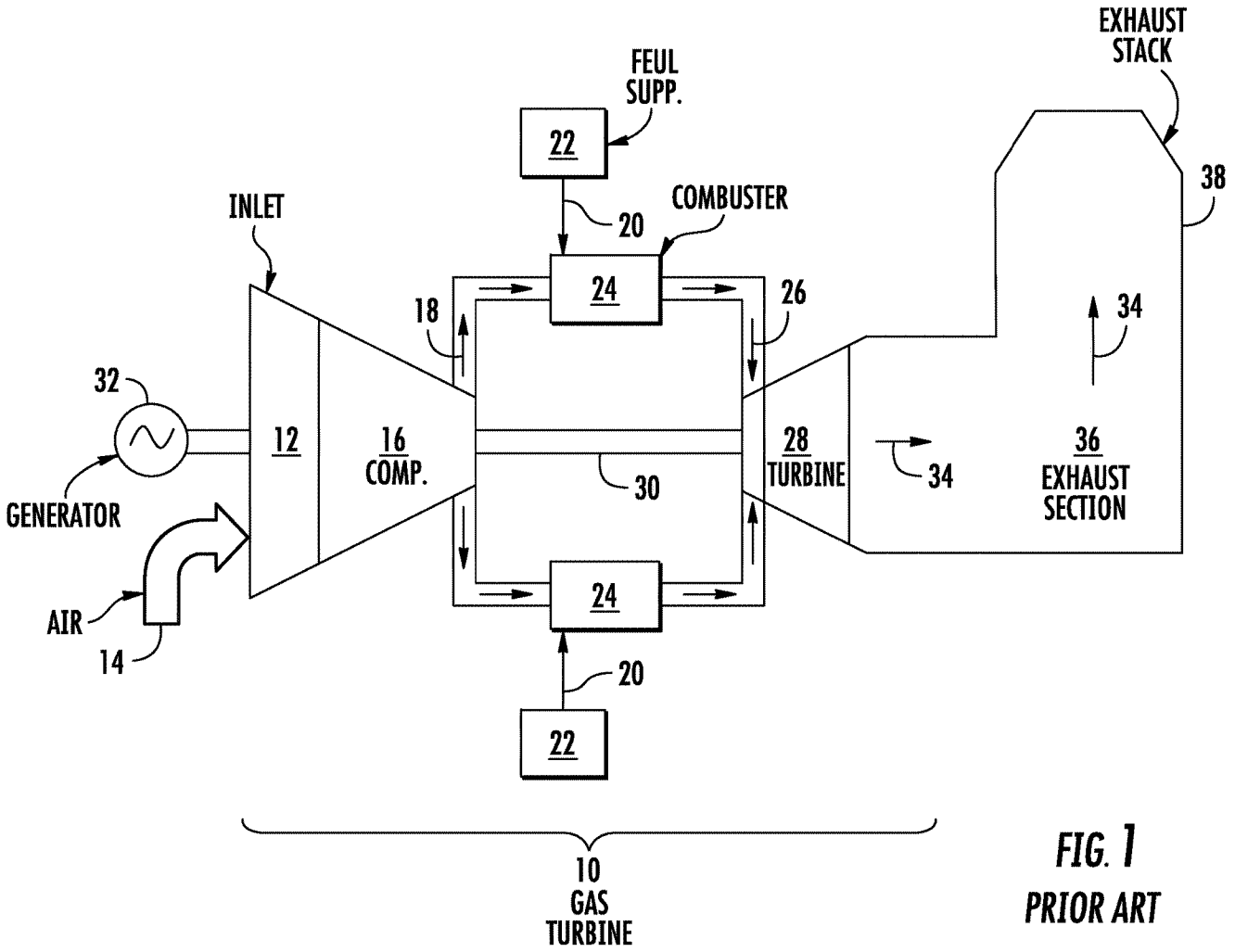
FIG. 1 PRIOR ART
FIG. 1 is a functional block diagram of an exemplary gas turbine within the scope of the present invention.

Reference will now be made in detail to present embodiments of the invention, one or more examples of which are illustrated in the accompanying drawings. The detailed description uses numerical and letter designations to refer to features in the drawings. Like or similar designations in the drawings and description have been used to refer to like or similar parts of the invention. As used herein, the terms "first", "second", and "third" may be used interchangeably to distinguish one component from another and are not intended to signify location or importance of the individual components. The terms "upstream" and "downstream" refer to the relative direction with respect to fluid flow in a fluid pathway. For example, "upstream" refers to the direction from which the fluid flows, and "downstream" refers to the direction to which the fluid flows. The term "radially" refers to the relative direction that is substantially perpendicular to an axial centerline of a particular component, and the term "axially" refers to the relative direction that is substantially parallel to an axial centerline of a particular component.

Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents. Although exemplary embodiments of the present invention will be described generally in the context of a combustor incorporated into a gas turbine for purposes of illustration, one of ordinary skill in the art will readily appreciate that embodiments of the present invention may be applied to any combustor incorporated into any turbomachine and is not limited to a gas turbine combustor unless specifically recited in the claims.

Various embodiments of this invention relate to a gas turbine having a compressor section, a combustion section downstream from the compressor section and a turbine section downstream from the combustion section. In particular embodiments, the invention provides a gas turbine assembly that controls and/or optimizes a gap or clearance between an aft end of a combustion liner and a first stage of stationary fuel nozzles as the gas turbine transitions through various thermal transients such as during startup and/or turndown operation of the gas turbine. The gas turbine assembly generally allows for an optimized gap size between the aft end of the liner and the first stage of stationary nozzles to allow for thermal growth and/or movement of the two components while at least partially controlling leakage of combustion gases through the gap during operation of the gas turbine.

Referring now to the drawings, wherein identical numerals indicate the same elements throughout the figures, FIG. 1 provides a functional block diagram of an exemplary gas turbine 10 that may incorporate various embodiments of the present invention. As shown, the gas turbine 10 generally includes an inlet section 12 that may include a series of filters, cooling coils, moisture separators, and/or other devices to purify and otherwise condition a working fluid (e.g., air) 14 entering the gas turbine 10. The working fluid 14 flows to a compressor section where a compressor 16 progressively imparts kinetic energy to the working fluid 14 to produce a compressed working fluid 18 at a highly energized state.

The compressed working fluid 18 is mixed with a fuel 20 from a fuel supply 22 to form a combustible mixture within one or more combustors 24. The combustible mixture is burned to produce combustion gases 26 having a high temperature and pressure. The combustion gases 26 flow through a turbine 28 of a turbine section to produce work. For example, the turbine 28 may be connected to a shaft 30 so that rotation of the turbine 28 drives the compressor 16 to produce the compressed working fluid 18. Alternately or in addition, the shaft 30 may connect the turbine 28 to a generator 32 for producing electricity. Exhaust gases 34 from the turbine 28 flow through an exhaust section 36 that connects the turbine 28 to an exhaust stack 38 downstream from the turbine 28. The exhaust section 36 may include, for example, a heat recovery steam generator (not shown) for cleaning and extracting additional heat from the exhaust gases 34 prior to release to the environment.

Figure 2:
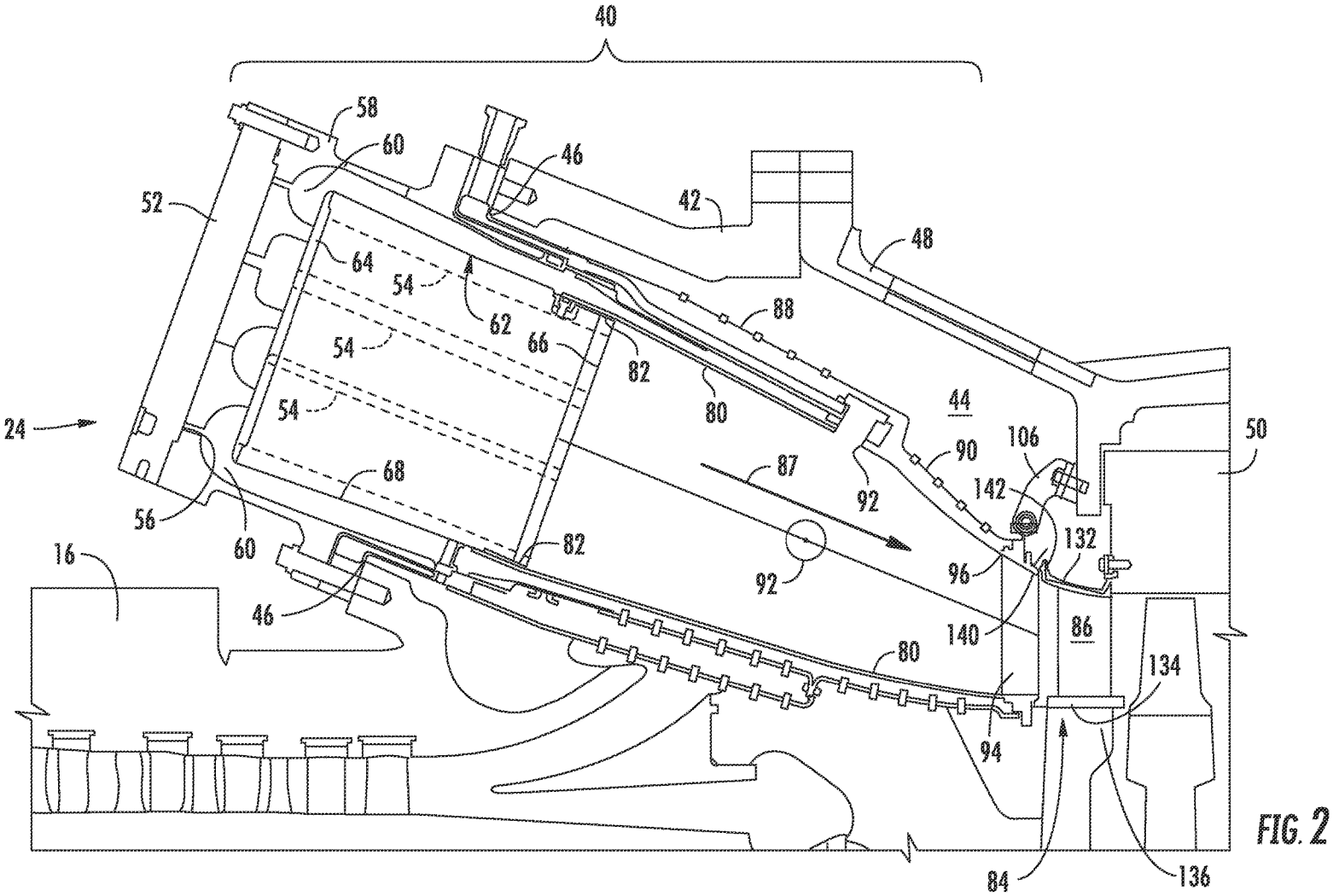
FIG. 2 is a cross-section side view of a portion of an exemplary gas turbine according to various embodiments of the present invention.

FIG. 2 provides a cross-section side view of a portion of an exemplary gas turbine 10 that may encompass various embodiments within the scope of the present disclosure. As shown in FIG. 2, a combustion section 40 generally includes a compressor discharge casing 42 that at least partially encases each combustor 24. The compressor discharge casing 42 at least partially defines a high pressure plenum 44 that is in fluid communication with the compressor 16. The compressor discharge casing 42 at least partially defines an opening 46 for installing the combustor 24. The high pressure plenum 44 surrounds at least a portion of each combustor 24. In particular embodiments, the high pressure plenum 44 is further defined by a portion of an outer turbine shell 48 that circumferentially surrounds an inner turbine shell 50.

As shown in FIG. 2, each combustor 24 includes a radially extending end cover 52. The end cover 52 may be coupled either directly or indirectly to the compressor discharge casing 42. One or more axially extending fuel nozzles 54 extend downstream from an inner surface 56 of the end cover 52. An annular spacer casing 58 may be disposed between the end cover 52 and the compressor discharge casing 42. The end cover 52 and/or the spacer casing 58 may at least partially define a head end plenum 60 within the combustor 24. An annular cap assembly 62 extends radially and axially within the spacer casing 58 and/or within the compressor discharge casing 42. The cap assembly 62 generally includes a radially extending base plate 64, a radially extending cap plate 66, and an annular shroud 68 that extends between the base plate 64 and the cap plate 66. In particular embodiments, the axially extending fuel nozzles 54 extend at least partially through the base plate 64 and/or the cap plate 66 of the cap assembly 62.

In particular embodiments, as shown in FIG. 2, an annular liner 80 such as a combustion liner or a transition duct at least partially surrounds a downstream end 82 of the cap assembly 62. The liner 80 extends downstream from the cap assembly 62 towards a first stage 84 of stationary nozzles or vanes 86. The liner 80 at least partially defines a hot gas path 87 through the high pressure plenum 44. The liner 80 may be at least partially surrounded by one or more flow sleeves 88 and/or impingement sleeves 90. In particular embodiments, one or more late lean fuel injector passages 92 may extend generally radially through the liner 80.

Figure 3:
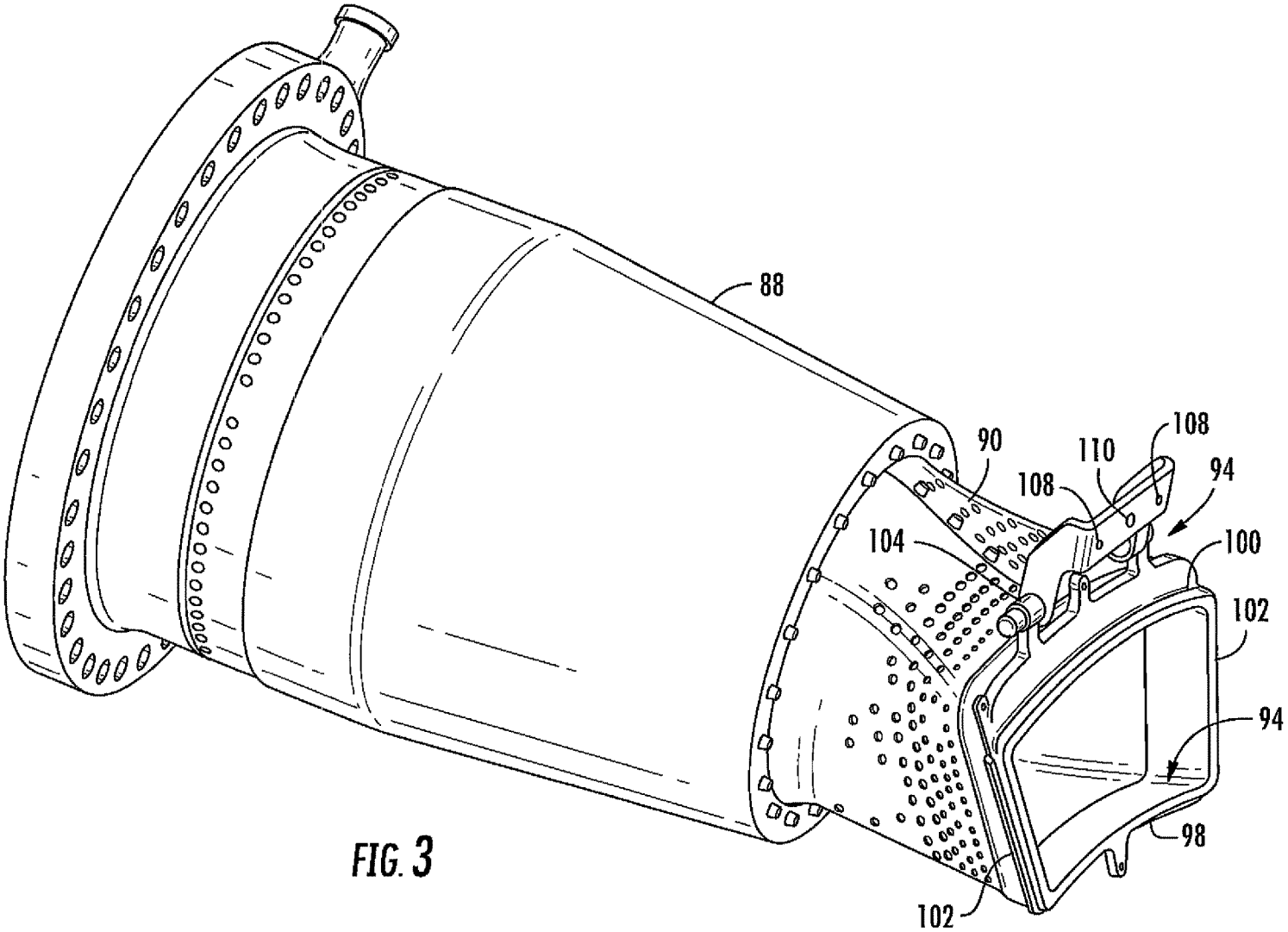
FIG. 3 is a perspective view of a portion of the gas turbine as shown in FIG. 2 according to various embodiments of the present disclosure.

In particular embodiments, as shown in FIG. 2, a support frame or aft frame 94 is disposed at a downstream end or aft end 96 of the liner 80. The aft frame 94 may be welded to the liner 80 or, in the alternative, the aft frame 94 and the liner 80 may be cast as a singular component. In particular embodiments, at least one of the flow sleeve(s) 88 and/or the impingement sleeve(s) 90 are coupled to the aft frame 94. As shown in FIG. 3, the aft frame 94 generally includes an inner portion 98, an outer portion 100 that is radially separated from the inner portion 98 with respect to an axial centerline of the aft frame 94, and a pair of opposing sides 102 that extend generally radially between the inner portion 98 and the outer portion 100 with respect to an axial center line of the liner 80. The aft frame 94 may be welded to the liner 80. In the alternative, the aft frame 94 and the liner 80 may be cast as a singular component. The aft frame 94 may include at least one coupling feature 104 such as a boss for attaching a mounting bracket 106 to the aft frame 94. For example, as shown in FIG. 3, the coupling feature(s) 104 may extend from the outer portion 100 of the aft frame 94. In addition or in the alternative, at least one of the at least one coupling feature(s) 104 may extend from the inner portion 98 and/or one of the sides 102 of the aft frame 94.

Figure 4:
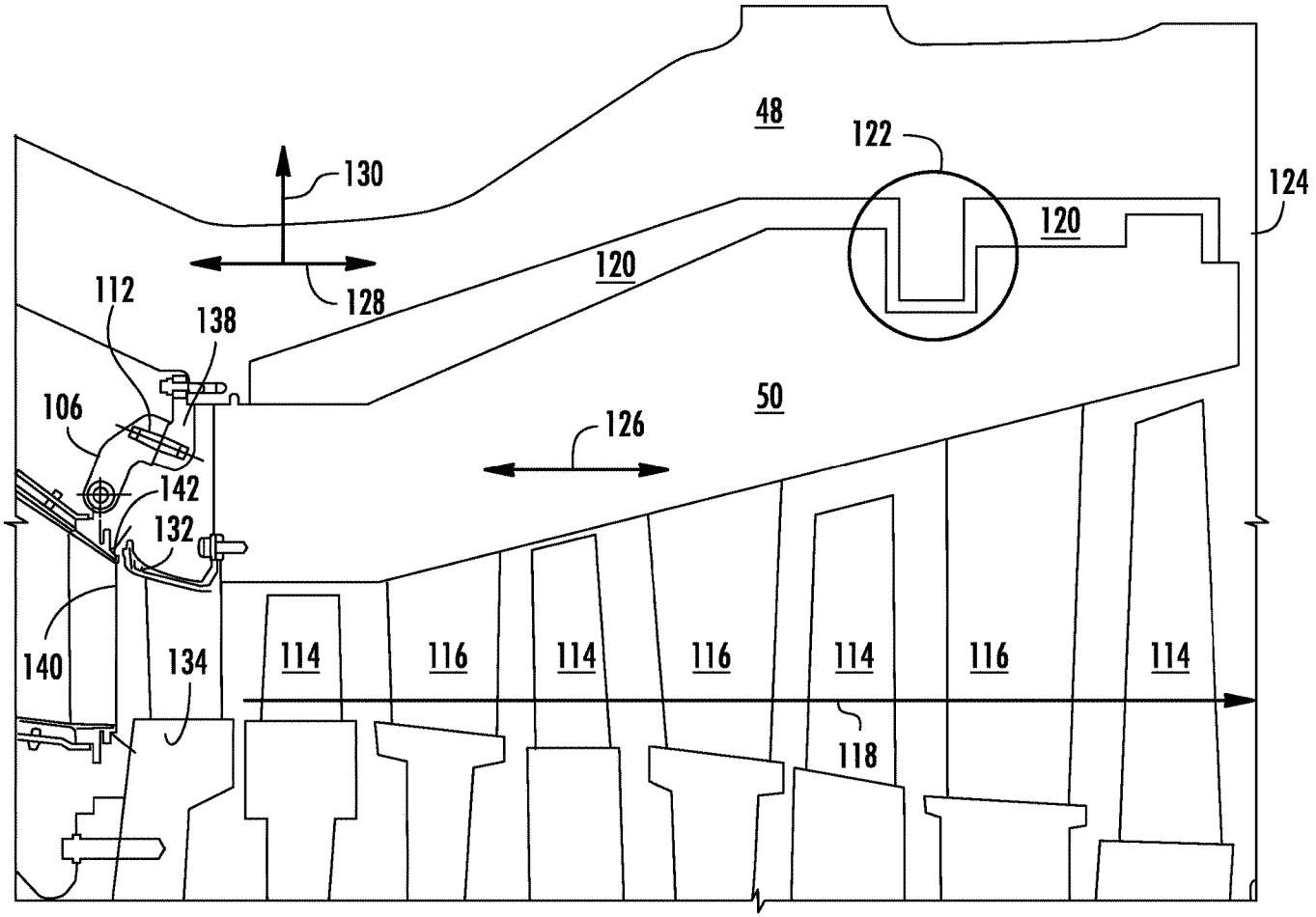
FIG. 4 is a cross-section side view of a turbine of the gas turbine according to various embodiments of the present disclosure.

In one embodiment, as shown in FIG. 4, the mounting bracket 106 is coupled to the outer portion 100 of the aft frame 94. The mounting bracket 106 may be configured to pivot or rotate in at least two directions with respect to the axial center line of the liner 80. For example, the mounting bracket 106 may pivot or rotate in a forward direction and/or aft direction with respect to the axial centerline of the liner 80. In this manner, the position or orientation of the mounting bracket 106 with respect to a mating surface such as the outer turbine shell 48 or the inner turbine shells 50 may be adjusted during installation of the liner 80 to accommodate for tolerance stack up issues and/or to guide the liner 80 into position during installation into the gas turbine 10. In addition, the mounting bracket 106 may pivot as the gas turbine 10 transitions between various thermal transient conditions such as during startup, shutdown and/or turndown operation, thereby at least partially maintaining or controlling a relative position with respect to the first stage 84 of the stationary nozzles 86. In various embodiments, the mounting bracket 106 at least partially defines one or more fastener passages 108 such as bolt holes. The mounting bracket 106 may at least partially define an alignment hole 110 that extends through the mounting bracket 106. In the alternative, the mounting bracket 106 may include an alignment pin 112 that extends outward from an aft face of the mounting bracket.

Figure 5:
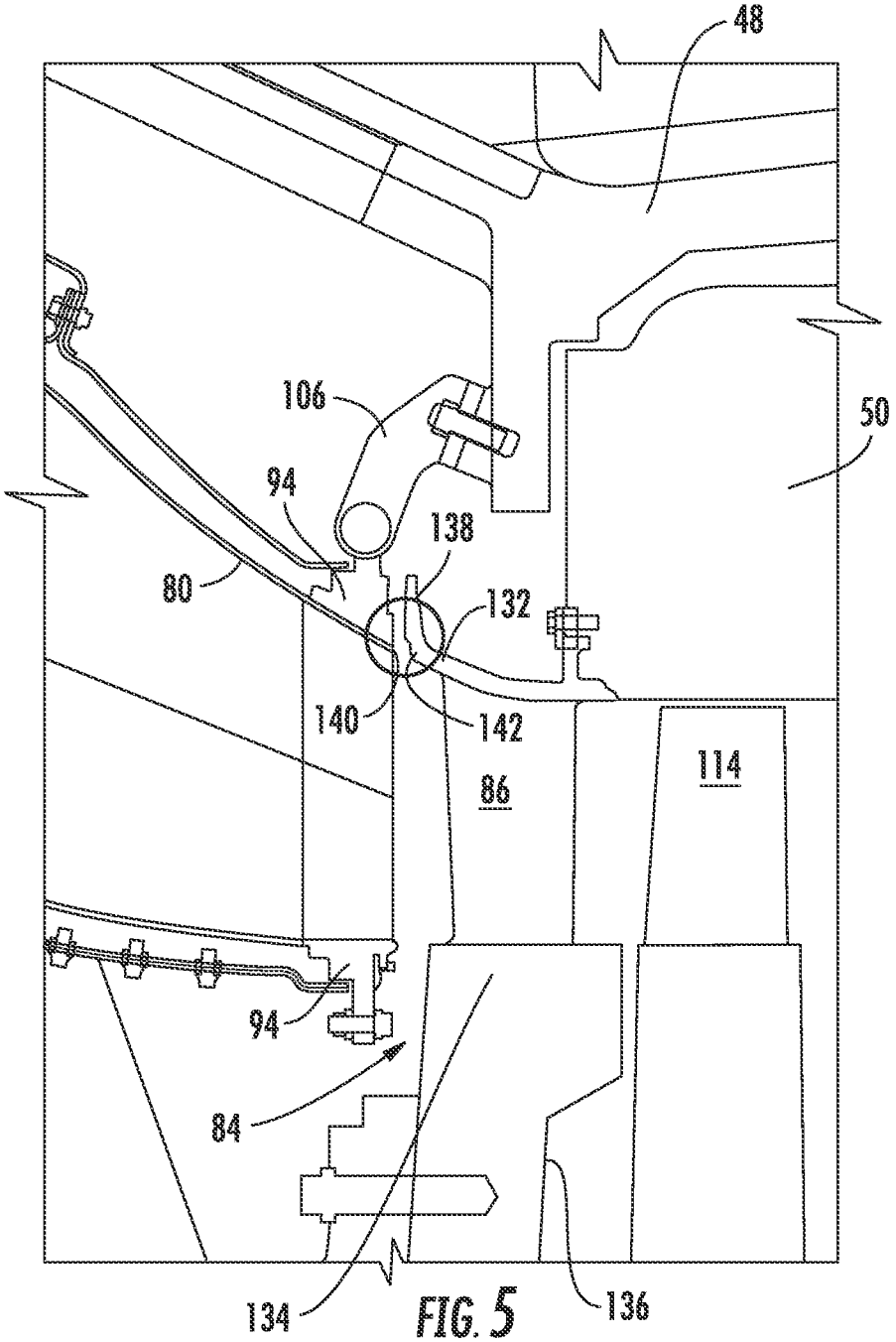
FIG. 5 is an enlarged cross-section side view of the gas turbine as shown in FIG. 2, according to at least one embodiment of the present disclosure.

FIG. 5 provides a cross-section side view of a portion of the turbine 28 according to at least one embodiment of the present disclosure. As shown in FIG. 5, the inner turbine shell 50 surrounds alternating stages or rows of rotatable turbine blades 114 and stationary nozzles 116, thereby at least partially defining a hot gas path 118 through the turbine 28. A cooling air plenum 120 is defined between the inner turbine shell 50 and the outer turbine shell 48. In particular embodiments, the inner turbine shell 50 is fixed to the outer turbine shell 48 at a connection point 122 that is proximate to an aft end 124 of the outer turbine shell 48. As a result, the inner turbine shell 48 expands or contracts within the outer turbine shell 48 in a generally axial manner as indicated by line 126 with respect to an axial centerline (not shown) of the gas turbine as the gas turbine cycles through various thermal transients, such as during startup, shutdown and/or turndown modes of operation. In contrast, the outer turbine shell 48 will tend to expand and contract in an axial direction that is opposite to the inner turbine shell as indicated by line 128 and/or a radial direction as indicated by line 130 as the gas turbine cycles through the various thermal transients. For example, as the gas turbine heats up, the inner turbine shell 50 will grow towards the aft frame 94 of the liner 80. The outer turbine shell 48 will expand radially outward with respect to the axial center line of the gas turbine and will expand axially towards the exhaust section 36 (FIG. 1).

Figure 6:
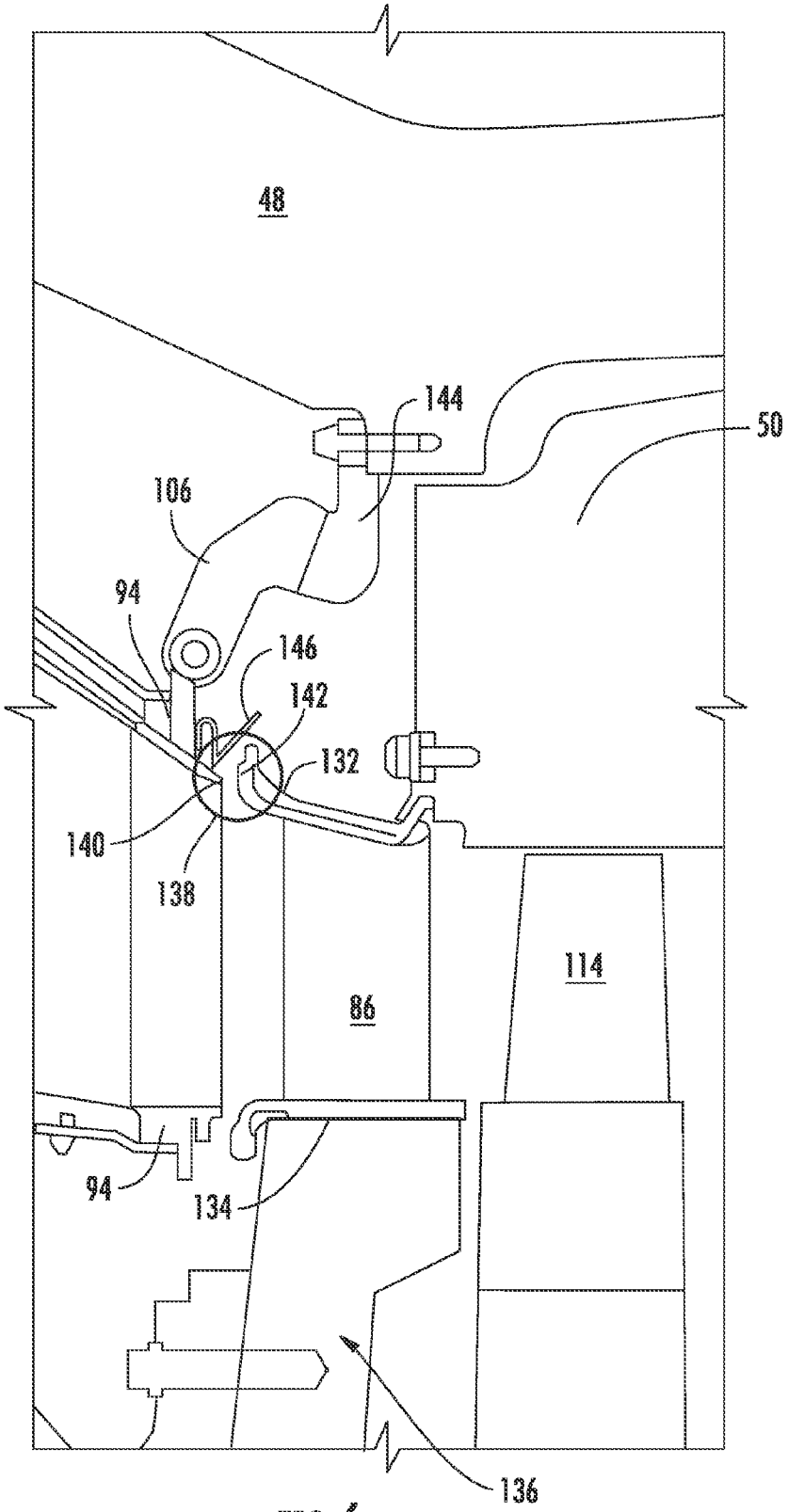
FIG. 6 is an enlarged cross-section side view of the gas turbine as shown in FIG. 4, according to at least one embodiment of the present disclosure.

As shown in FIG. 6, a top platform portion 132 of each stationary nozzle 86 of the first stage 84 is connected to the inner turbine shell 50. The top platform portion 132 may be pinned, screwed and/or bolted to the inner turbine shell 50. A bottom platform portion 134 of each stationary nozzle 86 of the first stage 84 may be coupled to and/or in contact with an inner support ring 136. The inner support ring 136 may be connected to the compressor 16 (FIG. 2) and/or the compressor discharge casing 42 (FIG. 2). The aft frame 94 is coupled to the outer turbine shell 48 via the mounting bracket 106. The mounting bracket 106 may be pinned, screwed and/or bolted to the outer turbine shell 48. A clearance gap or gap 138 is defined between an aft end 140 of the aft frame 94 and a leading edge 142 of the top platform portion 132 of each stationary nozzle 86. The gap 138 is sized to prevent contact between the aft frame 94 and the each stationary nozzle 86 as the gas turbine 10 cycles through various thermal transient conditions.

As shown in FIG. 6, an extension bracket 144 is coupled to the outer turbine shell 48 and the aft frame 94 is coupled to the outer turbine shell 48 via the mounting bracket 106 and the extension bracket 144. In various embodiments, a seal 146 may extend across the gap 138 to reduce and/or prevent leakage of the hot combustion gases from the hot gas path 118 through the gap 138 during operation of the gas turbine 10.

In operation, as the as the gas turbine 10 cycles through the various thermal transient conditions, the inner support ring 136 will grow at a different rate and/or in a different direction than the inner turbine shell 50 and/or the outer turbine shell 48. For example, the inner support ring 136 will generally expand radially outward with respect to an axial centerline of the gas turbine 10. As a result, the top portion 132 of each stationary nozzle 86 will translate generally axially as the gas turbine 10 heats and cools, while the bottom portion 134 of each stationary nozzle 86 will remain generally stationary, thereby tilting the top platform portion 132 of each stationary nozzle towards the aft frame 94. As the outer turbine shell 48 expands and contracts, the gap 138 between the aft end 140 of the aft frame 94 and the top portion 132 of the stationary nozzle 86, in particular the leading edge 142 of the top portion 132 of the stationary nozzle, is maintained or controlled by the mounting bracket 106, thereby controlling leakage through the gap 138 between the hot gas path 118 and the high pressure plenum 44. As a result, overall performance of the gas turbine 10 may be increased and undesirable emissions such as oxides of nitrogen (NOx) may be reduced.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal language of the claims.

What is claimed is:

1. A gas turbine, comprising:

a combustor including an annular liner having a downstream end and an aft frame disposed at the downstream end;

a first stage of stationary nozzles positioned downstream from the aft frame, each stationary nozzle of the first stage of stationary nozzles including a top platform and a bottom platform, wherein the bottom platform of each stationary nozzle of the first stage of stationary nozzles is connected to an inner support ring, the aft frame being decoupled and entirely axially spaced apart from the inner support ring;

a turbine comprising:

an outer turbine shell, wherein the aft frame is directly coupled to the outer turbine shell by a mounting bracket and wherein the aft frame is separated from an inner turbine shell such that a gap is defined between an aft end of the aft frame and a leading edge of the top platform portion of the first stage of the stationary nozzles;

the inner turbine shell disposed within the outer turbine shell, the inner turbine shell circumferentially surrounding multiple rows of stationary nozzles and multiple rows of turbine rotor blades disposed downstream from the first stage of stationary nozzles, the top platform of each stationary nozzle of the first stage if stationary nozzles being connected to a forward wall of the inner turbine shell, the outer turbine shell being connected to the inner turbine shell at a connection point positioned downstream of the first stage of stationary nozzles, wherein the aft frame moves with the outer turbine shell and the first stage of stationary nozzles moves with the inner turbine shell relative to the aft frame during one or more thermal transient conditions.

2. The gas turbine as in claim 1, wherein the inner support ring is connected to at least one of a compressor and a compressor discharge casing of the gas turbine.

3. The gas turbine as in claim 1, further comprising a cooling air plenum defined radially between the inner turbine shell and the outer turbine shell.

4. The gas turbine as in claim 1, wherein the outer turbine shell defines a radial slot and the inner turbine shell defines a radial projection, wherein the radial projection extends radially into the radial slot to define the connection point between the outer turbine shell and the inner turbine shell.

5. The gas turbine as in claim 1, wherein the inner turbine shell is connected to the outer turbine shell at the connection point defined proximate to an aft end of the outer turbine shell.

6. The gas turbine as in claim 1, wherein the mounting bracket includes an extension bracket and a pivoting mounting bracket.

7. The gas turbine as in claim 1, further comprising a seal that extends across the gap formed between the aft frame and a platform of a respective stationary nozzle of the first stage of stationary nozzles.

8. The gas turbine as in claim 1, wherein a forward end of the outer turbine shell is connected to a compressor discharge casing.

9. The gas turbine as in claim 1, wherein aft frame is connected to the outer turbine shell at a position located upstream of the inner turbine shell.

10. The gas turbine as in claim 1, wherein the aft frame is radially spaced apart from the inner support ring.

* * * * *